United States Patent [19]

Ancona et al.

[11] Patent Number: 4,741,486

[45] Date of Patent: May 3, 1988

[54] PAPER TOWEL HOLDER

[75] Inventors: Jane Ancona; Bruce Ancona, both of New York, N.Y.

[73] Assignee: M. Kamenstein, Inc., White Plains, N.Y.

[21] Appl. No.: 38,995

[22] Filed: Apr. 16, 1987

[51] Int. Cl.[4] ..... B65H 19/00

[52] U.S. Cl. ..... 242/55.2; 242/55.54

[58] Field of Search ..... 242/129, 55.2, 55.54, 242/129.5, 129.7, 129.8, 141, 134; 248/284, 287, 291; D6/518, 521, 522, 523

[56] References Cited

U.S. PATENT DOCUMENTS

| | | | |
|---|---|---|---|
| 1,663,305 | 3/1928 | Hudson | 242/55.2 |
| 1,665,738 | 4/1928 | Hoegger | 242/55.2 |
| 2,036,035 | 3/1936 | Giallanza | 242/129.6 X |
| 2,517,809 | 8/1950 | Tarzian | 242/55.2 |
| 2,749,056 | 6/1956 | Jenkins | 242/55.2 |
| 3,362,653 | 1/1968 | Carlisle | 242/55.2 |
| 3,477,656 | 11/1969 | Muller | 242/55.2 |
| 3,516,615 | 6/1970 | Wickenberg | 242/55.2 |
| 3,593,936 | 7/1971 | Davis | 242/55.2 |
| 3,923,265 | 12/1975 | Kruger et al. | 242/55.54 |
| 4,556,160 | 12/1985 | Kurz et al. | 242/55.2 X |

*Primary Examiner*—David Werner
*Attorney, Agent, or Firm*—Henry R. Lerner

[57] ABSTRACT

A device for holding and dispensing paper toweling in roll form, includes a base adapted to be mounted onto a supporting surface for supporting the device; a shaft for rotatably supporting the roll, the shaft including (a) a first shaft portion having first and second opposite ends; (b) a second shaft portion having a first end secured to the base and a second end secured to a first end of the first shaft portion so as to secure the first and second shaft portions selectively in either a co-axial relation or a perpendicular relation; and (c) a third shaft portion having a free end and being telescopically receivable in the first shaft portion in a retracted position when the first and second shaft portions are secured in the co-axial relation and an extended position when the first and second shaft portions are secured in perpendicular relation, whereby the effective shaft length corresponds all times to the length of the paper toweling roll; and a closure cap secured to the free end of the third shaft portion for restraining the roll on the shaft; and a tension bar slidably mounted in the closure cap and normally biased radially inward thereof to engage the outer surface of the paper towel roll.

20 Claims, 5 Drawing Sheets

70
72
22
40
30
28
20
24
36
38
16
6
7
12b
68
66
76
78
80
82
8
42
12a
12
10
12c
60
84
86
96
98
102
104
106
108
136
18
88
62
92
90

PAPER TOWEL HOLDER

BACKGROUND OF THE INVENTION

This invention relates generally to apparatus for operatively holding a roll of sheet material, and more particularly, is directed to a paper towel holder from which the sheet material can be dispensed.

Conventionally, paper towel holders include an elongated base which is secured to a wall, a cabinet or the like. Two arms extend outwardly in parallel relation from opposite sides of the base, the arms including means for operatively engaging through the opposite ends of the central longitudinal aperture of the roll of paper towels. Such means may take the form of a roller extending between the two arms, or alternatively, may include two bosses, one on each arm for engaging only in the ends of the central longitudinal aperture.

Such conventional paper towel holders, however, are not very versatile. Specifically, where there is a limited amount of space for mounting the paper towel holder, such conventional paper towel holders cannot be used. This is because a large area is required for securement of the elongated base. Still further, with such conventional paper towel holders, the roll of paper towels must usually be mounted horizontally. Often times, however, it is necessary and/or desirable to mount the roll of paper towels vertically, for example, to the underside of a kitchen cabinet. Such vertical mounting cannot be achieved with such conventional paper towel holders, unless there is a sufficient vertical wall space for mounting the same.

Additionally, with such conventional paper towel holders, the next sheet to be used often hangs loosely down from the mounted roll. This may result in unravelling of the paper towels from the roll, particularly if the roll is vertically mounted to a wall. Another related problem with such freely hanging paper towels is that, when the paper towels are pulled off the roll, more than the desired number of sheets of the paper towel tend to be pulled off, particularly of the next sheet of paper towel to be removed does not fully tear along its perforated tear line when being pulled off the roll. This is because there is no restraining means for holding the remaining sheets of paper towel on the roll when the individual sheets are being pulled off.

OBJECTS AND SUMMARY OF THE INVENTION

Accordingly, it is an object of the present invention to provide a paper towel holder that avoids the aforementioned difficulties encountered with the prior art.

More particularly, it is an object of the present invention to provide a paper towel holder which can be mounted vertically or horizontally from any relatively small surface, whether such surface extends horizontally or vertically.

It is another object of the present invention to provide a paper towel holder having a small base area for securement to any relatively small surface.

It is still another object of the present invention to provide a paper towel holder in which the free end of the next sheet to be removed is releasably held against the roll.

In accordance with the present invention, the paper towel holder includes a base adapted to be mounted to a flat surface, and a shaft secured to the base for holding a roll of paper toweling. The shaft is formed of first, second and third shaft portions. The second shaft portion has one end secured to the base, and an opposite end secured to one end of the first shaft portion, the angular relation between the first and second shaft portions being changeable to a co-axial relation or a perpendicular relation. The first shaft portion is hollows and receives therein the third shaft portion in a telescoping manner. The third shaft-portion can be positioned in the first shaft portion in a retracted or extended position.

When the first and second shaft portions are co-axial, the third shaft portion is in its retracted position, so that the roll of paper toweling is supported on the first and second shaft portions. When the first and second shaft portions are perpendicular to each other, the third shaft portion is in its extended position, so that the roll of paper toweling is supported on the first and third shaft portions.

In accordance with an aspect of the present invention, a device for holding and dispensing paper toweling in roll form, includes base means adapted to be mounted onto a supporting surface for supporting the device; shaft means for rotatably supporting the roll, the shaft means including (a) a first shaft portion having first and second opposite ends; (b) a second shaft portion having a first end secured to the base means and a second end secured to a first end of the first shaft portion so as to secure the first and second shaft portions selectively in either a co-axial relation or a perpendicular relation; and (c) a third shaft portion having a free end and being telescopically receivable in the first shaft portion in a retracted position when the first and second shaft portions are secured in the co-axial relation and an extended position when the first and second shaft portions are secured in perpendicular relation, whereby the effective shaft length corresponds all all times to the length of the paper toweling roll; and closure means secured to the free end of the third shaft portion for releasably restraining the roll on the shaft means.

In accordance with another aspect of the present invention, apparatus for operatively holding a roll of sheet material having a central longitudinal aperture, includes shaft means for rotatably supporting the roll, the shaft means including a first extendable shaft portion positionable through the longitudinal aperture and having a first end and a second, opposite end, and a second shaft portion having a first end and a second, opposite end, the first end of the second shaft portion being secured at a selected angular position to the second end of the first shaft portion, the second shaft portion being positionable through the longitudinal aperture when the first and second shaft portions are colinear; base means secured to the second end of the second shaft portion for supporting the shaft means; and closure means secured to the first end of the first shaft portion for releasably restraining the roll on the shaft means.

The above and other objects, features and advantages of the present invention will become readily apparent from the following detailed description thereof which is to be read in connection with the accompanying drawings.

DETAILED DESCRIPTION OF A PREFERRED EMBODIMENT

Figures 5, 6, 7:
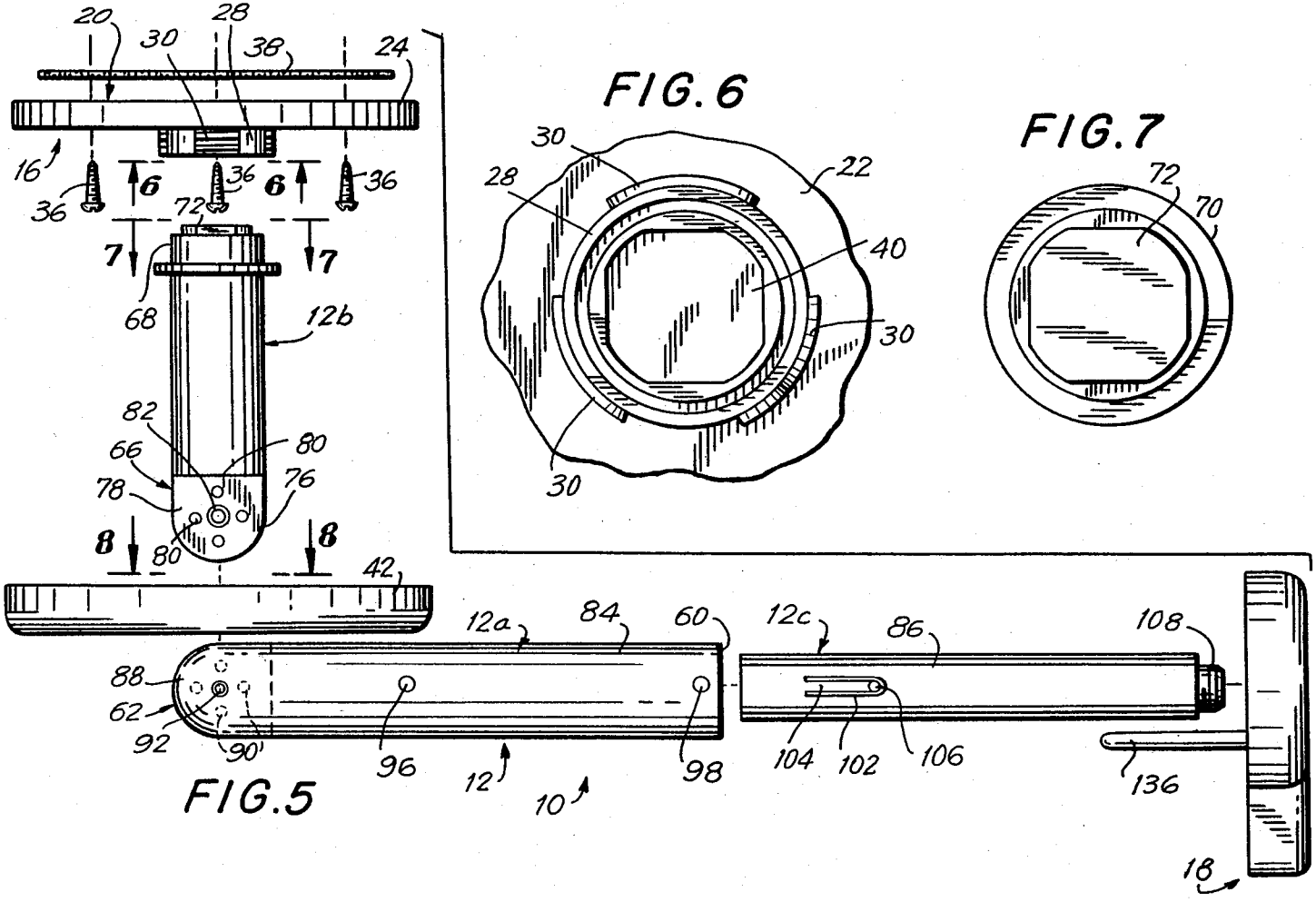
FIG. 5 is an exploded, elevational view of the paper towel holder according to the present invention, mounted in the manner illustrated in FIG. 4.
FIG. 6 is a plan view of a portion of the paper towel holder, taken along line 6—6 of FIG. 5.
FIG. 7 is a plan view of a portion of the paper towel holder, taken along line 7—7 of FIG. 5.
Figure 8:
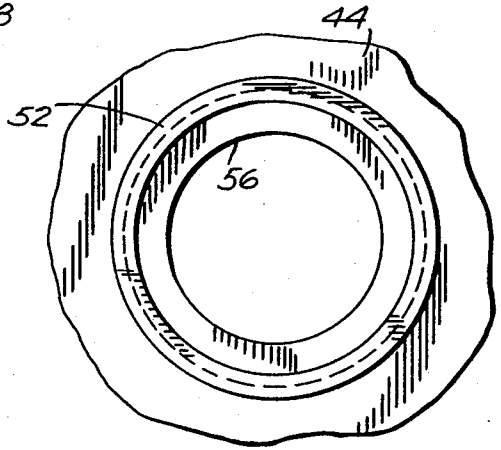
FIG. 8 is a plan view of a portion of the paper towel holder, taken along line 8—8 of FIG. 5.

Referring to the drawings in detail, and initially to FIG. 5 thereof, paper towel holder 10 according to the present invention generally includes shaft means 12 comprised of shaft portions 12*a*, 12*b* and 12*c* for rotatably supporting a roll 14 of paper towels, base means 16 secured to a fixed surface (wall or cabinet) and in engagement with one end of shaft means 12 for supporting shaft means 12, and closure means 18 secured to the opposite end of shaft means 12 for releasably restraining roll 14 on shaft means 12. Unless otherwise indicated, all parts can be formed of a suitable plastic material.

As is conventional, roll 14 includes a central, hollow cylindrical tube 14*a* made of cardboard or like material and having a central longitudinal aperture 14*b*, and a plurality of end-to-end connected sheet material 14*c* wrapped about tube 14*a*. Of course, although sheet materials 14*c* are referred to as paper towels throughout this application, the present invention is designed to cover any suitable sheet materials, such as toilet tissues and the like.

As shown best in FIGS. 5, 6, 8 and 9, base means 16 includes a weighted circular base section 20 formed by a flat circular bottom 22, an upstanding peripheral annular wall 24 and an annular boss 28 connected centrally to bottom 22 and formed with external screw-threads 30 therearound. Flat bottom 22 is also formed with a plurality of apertures 32, whereby bottom 22 can be secured to a wall surface 34 by screws 36 extending through apertures 32. In order to prevent damage to wall surface 34, an annular gasket seal 38, made of rubber or like material, can be secured to the underside of bottom 22, that is, so as to be positioned between wall surface 34 and bottom 22.

As shown best in FIG. 6, a substantially octagonal recess 40 is formed in bottom 22 within annular boss 28 for receiving a complementary octagonal end of shaft portion 12*b* and preventing rotation of shaft means 12, as will be appreciated from the detailed description which follows.

Figure 9:
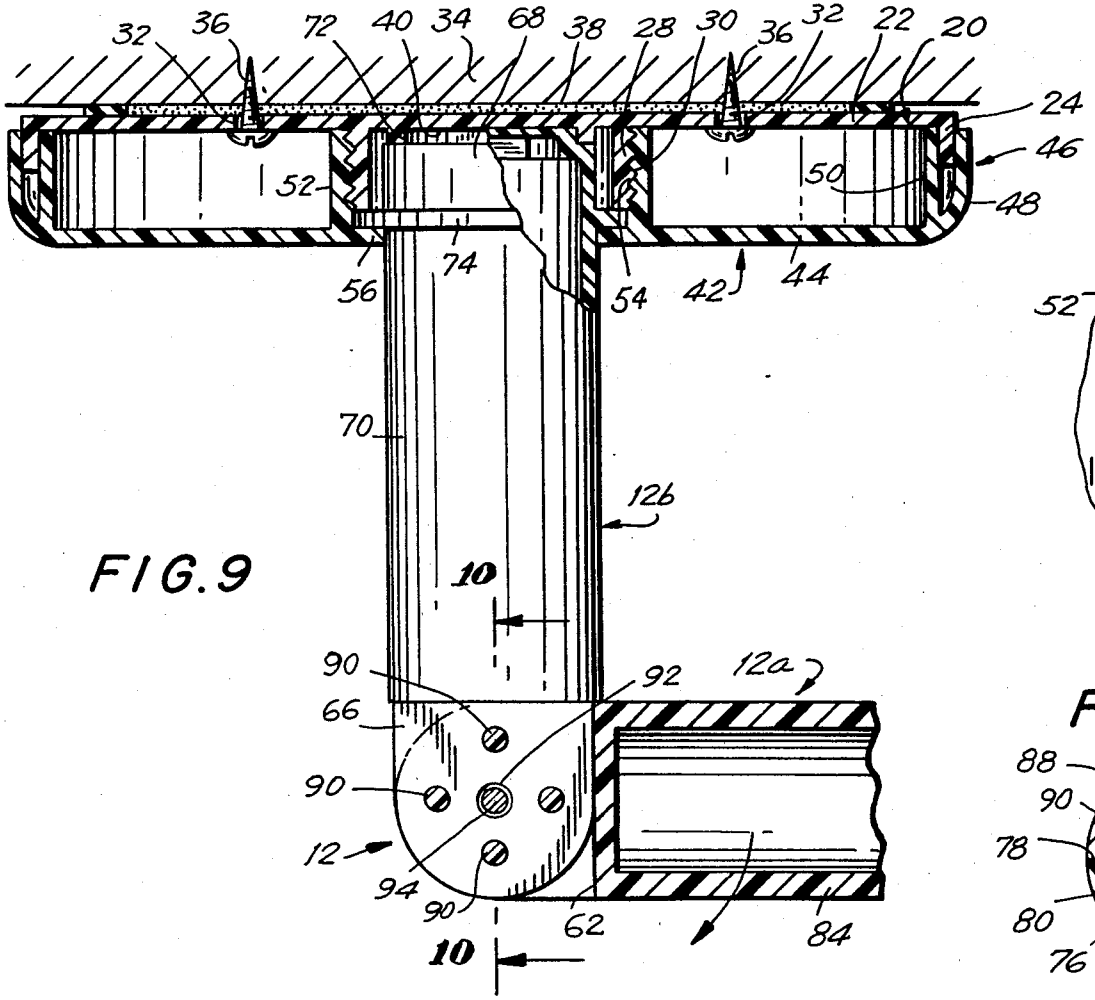
FIG. 9 is a partial cross-sectional view of a portion of the paper towel holder, taken along line 9—9 of FIG. 1.

Base means 16 also includes a base cover 42. Base cover 42 includes a flat upper wall 44 and bifurcated annular wall 46 extending around the periphery thereof. Thus, wall 46 is formed of a first outer peripheral wall 48 and a second inner peripheral wall 50 in radially spaced relation thereto. As shown in FIG. 9, when base cover 42 is secured on base section 20, annular wall 24 of base section 20 fits between outer and inner peripheral walls 48 and 50. Base cover 42 also includes a central annular boss 52 having internal screw threads 54, whereby base cover 42 can be screw-threadedly received on base section 20, that is, such that internal screw threads 54 screw-threadedly engage external screw threads 30.

In addition, upper wall 44 extends slightly inwardly of boss 52 so as to provide an inwardly directed annular flange 56 coplanar with upper wall 44, for maintaining shaft means 12 secured to base means 16, as will be described in greater detail hereinafter.

Referring now to FIGS. 5 and 9–13, shaft means 12 is seen to include a first shaft portion 12*a*, a second shaft portion 12*b* and a third shaft portion 12*c* positionable through the central longitudinal aperture 14*c* of roll 14. First shaft portion 12*a* has a first end 60 and a second opposite end 62, and second shaft portion 12*b* has a first end 66 and a second opposite end 68, with the first end 66 of second shaft portion 12*b* being secured at a selected angular position to the second end 62 of first shaft portion 12*a*. Second shaft portion 12*b* is positionable through longitudinal aperture 14*c* of roll 14 only when first and second shaft portions 12*a* and 12*b* are colinear.

Second shaft portion 12*b* is formed by a generally cylindrical rod 70 having an octagonal projecting surface 72 at second end 68, as shown in FIGS. 5 and 7. Octagonal projecting surface 72 has dimensions complementary to those of octagonal recess 40. Accordingly, when octagonal projecting surface 72 is seated within octagonal recess 40, as shown in FIG. 9, rotation of second shaft portion 12*b*, and thereby of shaft means 12, is prevented.

In addition, an annular flange 74 is secured around cylindrical rod 70, spaced slightly from second end 68. In this manner, second shaft portion 12*b* can be releasably secured to base means 16. This is accomplished as follows. First, base section 20 is secured to wall surface 34 by screws 36. Then, second shaft portion 12*b* is placed within base 20 such that octagonal projecting surface 72 is seated within octagonal recess 40. Then, base cover 42 is slipped over second shaft portion 12*b* and screw-threaded onto base 20. When base cover 42 is screw-threaded onto base 20, annular wall 24 fits between outer and inner peripheral walls 48 and 50, as described above. At the same time, annular flange 56 clamps down on annular flange 74 and sandwiches the latter between annular flange 56 and the upper surface of boss 28, as best shown in FIG. 9. Accordingly, second shaft portion 12*b* is releasably held in a tight manner by base means 16 and is prevented from rotating therein.

First end 66 of second shaft portion 12*b* is formed with a rounded hemispherical section 76 which has been cut in half along a longitudinal center line of cylindrical rod 70 so as to define a flat surface 78. A plurality of hemispherical recesses 80 are formed in flat surface 78 and are equally spaced from each other in a diamond-shaped configuration and equally spaced from a central screw-threaded hole 82. Thus, recesses 80 lie along a circular path, with the center of the circle being constituted by screw-threaded hole 82 and each recess 80 being spaced 90 degrees from an adjacent recess. In addition, two of the recesses 80 are formed in line with screw-threaded hole 82, and co-axial with the longitudinal axis of cylindrical rod 70.

Figure 10:
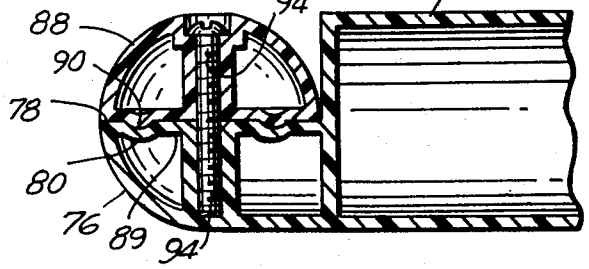
FIG. 10 is a cross-sectional view of the paper towel holder, taken along line 10—10 of FIG. 9.

First shaft portion 12*a* includes a tubular rod 84 adapted to telescopically receive third shaft portion 12*c* therein. As shown best in FIGS. 5 and 9, tubular rod 84 includes the aforementioned second end 62 of first shaft portion 12*a*, which is formed similarly to first end 66 of second shaft portion 12*b*. More specifically, the second end 62 of tubular rod 84 is formed with a hemispherical section 88 which is cut in half longitudinally along a center line of tubular rod 84 so as to provide a corresponding flat surface, as shown in FIG. 10, having a plurality of hemispherical projections 90 arranged around a center aperture 92 in an arrangement which is the same as that of hemispherical recesses 80 about screw-threaded hole 82. The flat surface of hemispherical section 88 is positioned against flat surface 78 such that projections 90 fit within recesses 80. A screw 94 is then inserted through center aperture 92 and screw-threadedly received within screw-threaded hole 82 to secure outer telescoping rod 84 to cylindrical rod 70 either (a) co-axially as in FIG. 3 or (b) perpendicular to each other as in FIGS. 1, 2 and 4. This is accomplished by loosening screw 94, rotating outer telescoping rod 84 with respect to cylindrical rod 70 so that different projections 90 fit within different recesses 80, and then tightening screw 94. In this regard, telescoping rod 84 is pivotally secured to cylindrical rod 70 when screw 94 is loosened, and can be tightened in one of the aforementioned pivoted positions.

As shown in FIGS. 5 and 9–11, the remainder of tubular rod 84 is hollow to receive third shaft portion 12*c*. Further, the purpose for which will be described in greater detail hereinafter, a first hole 96 is provided in the wall of tubular rod 84, slightly offset from the midpoint of tubular rod 84 and a second hole 98 is provided in the wall of tubular rod 84 adjacent the end 60.

Figure 11:
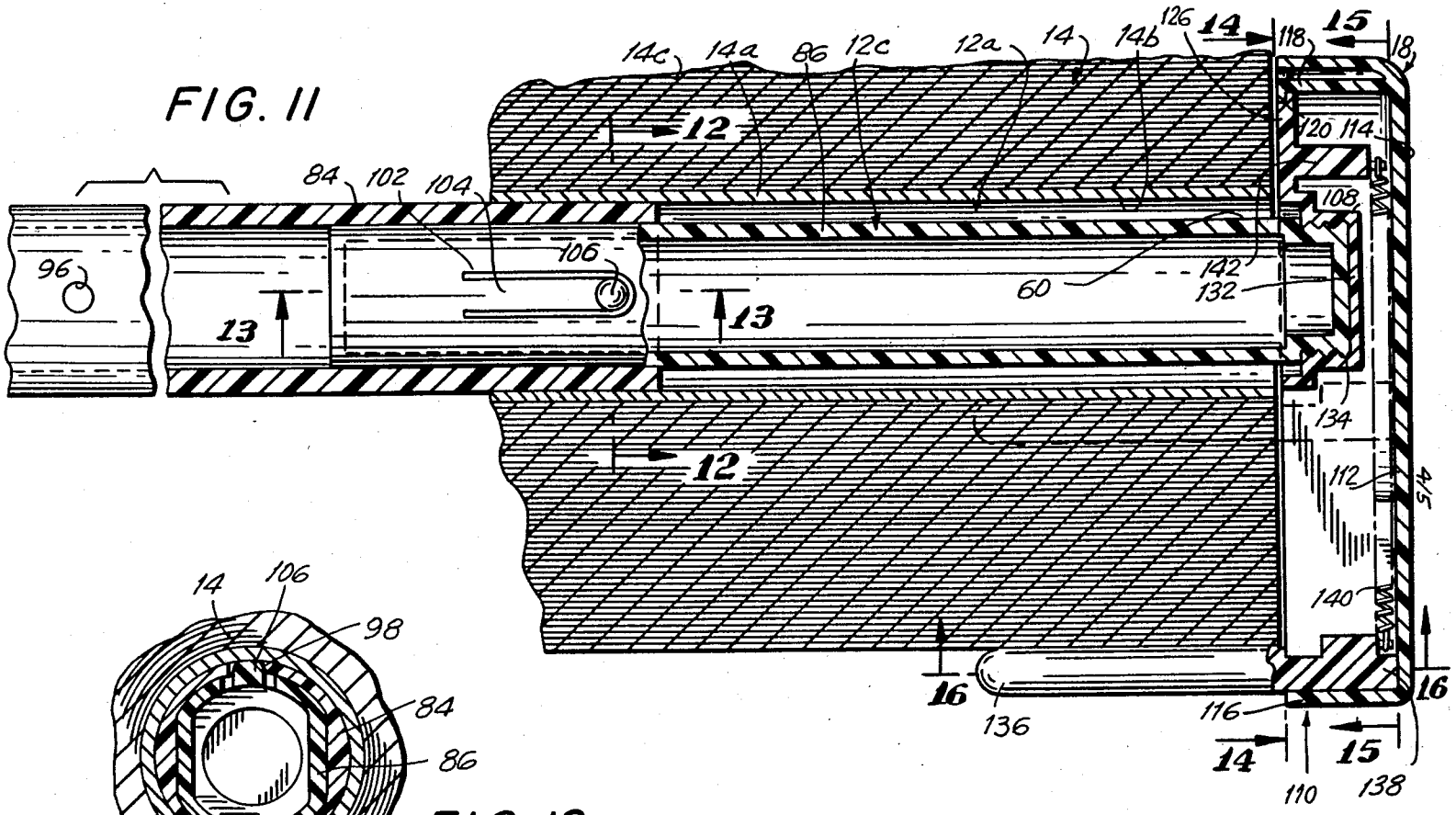
FIG. 11 is a cross-sectional view of a portion of the paper towel holder, taken along line 11—11 of FIG. 1.
Figure 12:
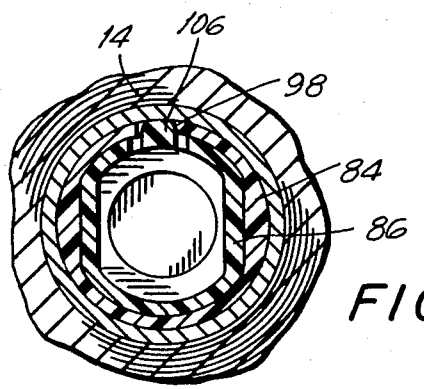
FIG. 12 is a cross-sectional view of the paper towel holder, taken along line 12—12 of FIG. 11.
Figure 13:
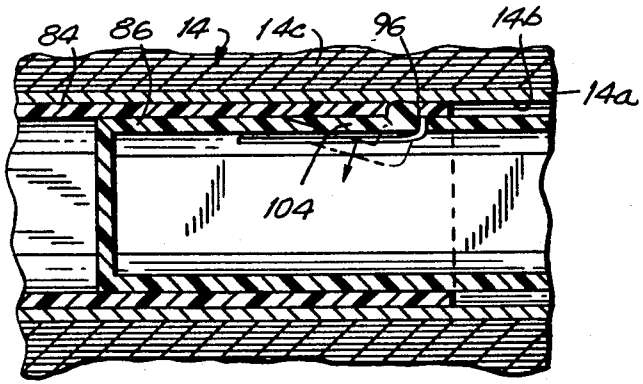
FIG. 13 is a cross-sectional view of the paper towel holder, taken along line 13—13 of FIG. 11.

Referring to FIGS. 5 and 11–13, third shaft portion 12*c* is also formed as a hollow tubular rod 86 and is telescopically received within tubular rod 84. An elongated U-shaped portion of the wall of tubular rod 86 is cut away as at 102 to form a leaf spring 104, the free end of which has a lock button 106 extending outwardly therefrom. Thus, as shown in FIG. 13, when tubular rod 86 is telescopically introduced within tubular rod 84, the inner surface of tubular rod 84 biases leaf spring 104 inwardly. To lock outer and inner telescoping rods 84 and 86 together, inner telescoping rod 86 is inserted within rod 84 until either lock button 106 is biased by leaf spring 104 into first hole 96 or second hole 98. Thus, when lock button 106 is inserted within first hole 96, inner telescoping rod 86 of third shaft portion 12*c* is in its retracted position, in which it contributes a short effective length to shaft means 12. When lock button 106 is inserted within second hole 98, inner telescoping rod 86 of third shaft portion 12*c* is in its extended position, in which it contributes a long effective length to shaft means 12. In either position of inner telescoping rod 86, the free end thereof constitutes the free end of shaft means 12. As shown in FIGS. 5 and 11, the free end of inner telescoping rod 86 is provided with external screw-threads 108 therearound for receiving closure means 18.

In addition, as shown in FIG. 12, portions of the walls of outer telescoping rod 84 and inner telescoping rod 86 are formed with flat sides to prevent rotation of the two with respect to each other. In this regard, alignment of lock button 106 with first hole 96 or second hole 98 can always easily and readily be achieved.

Referring now to FIGS. 5, 11 and 14–16, closure means 18 includes a closure cap 110 formed of an outer cover 112 having a circular flat wall 114 and an outer annular peripheral wall 116 secured thereto. In addition, a plurality of, for example, three, securing legs 118 are secured to flat wall 114 equidistantly thereabout and spaced inwardly slightly from outer annular peripheral wall 116, each securing leg 118 having an inwardly directed tab 120 at the free end thereof.

Figure 15:
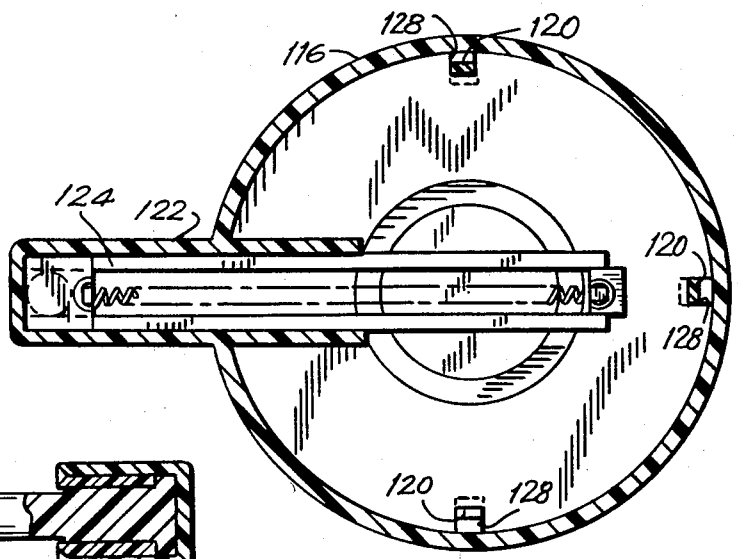
FIG. 15 is a cross-sectional view of the paper towel holder, taken along line 15—15 of FIG. 11.
Figure 14:
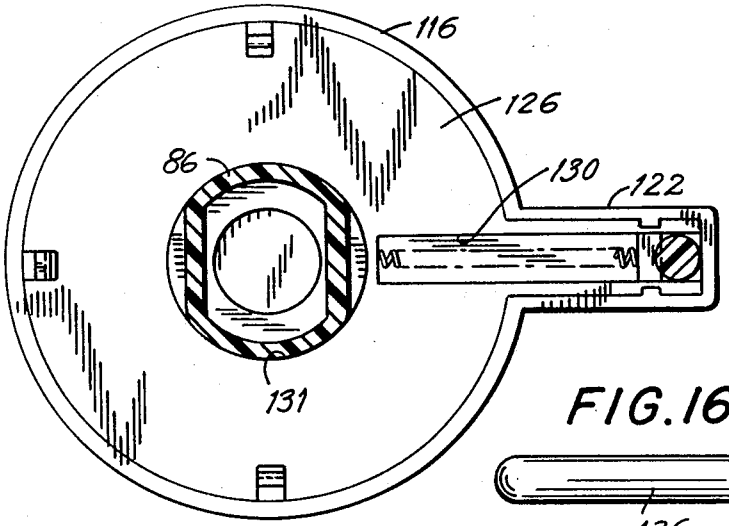
FIG. 14 is a cross-sectional view of the paper towel holder, taken along line 14—14 of FIG. 11.
Figure 16:
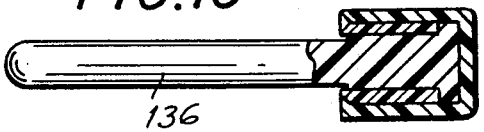
FIG. 16 is a cross-sectional view of the paper towel holder, taken along line 16—16 of FIG. 11.

As best shown in FIGS. 14 and 15, outer cover 112 also includes a trackway 122 formed integrally with outer annular peripheral wall 116 and extending radially thereof. Specifically, trackway 122 extends both radially outwardly and radially inwardly of peripheral wall 116. Trackway 122 defines an elongated track 124, the purpose for which will be described in greater detail hereinafter.

In addition, closure cap 110 includes a circular base wall 126 which fits over the open end of flat wall 114 and has a diameter slightly less than that of peripheral wall 116 so as to fit therein. Base wall 126 includes three cut-out sections 128 spaced equally therearound into which tabs 120 are biased by securing legs 118 so that tabs 120 hold base wall 126 within annular peripheral wall 116 at the open end thereof. In addition, base wall 126 is cut out at its position over trackway 122 so as to expose the latter as indicated at 130 in FIG. 14, and is cut-away at a central opening 131.

Base wall 126 also includes a circular recess wall 132 which is exposed through central opening 131 and which has internal screw threads 134 by which closure means 18 can be screw-threadedly received on the end of inner telescoping rod 86. In other words, internal screw threads 134 screw-threadedly mate with external screw threads 108 at the end of inner telescoping rod 86. With such arrangement, roll 14 is releasably restrained on shaft means 12. When roll 14 is used up, closure means 18 is unscrewed from the end of inner telescoping rod 86 to remove the used roll 14 and insert a new roll 14.

As also shown in FIGS. 11 and 14–16, paper towel holder 10 further includes sheet material hold-down means constituted by a tension bar 136 which extends from closure means 18 toward and substantially parallel with outer telescoping rod 84. Tension bar 136 is a cylindrical bar which rests against the outer surface of roll 14 and includes a slide portion 138 slidably received within trackway 122 so as to ride within track 124. A metal tension spring 140 is secured at one end to slide portion 138 and extends to the opposite side of closure cap 110 so that its opposite end is secured to a projection 142 upstanding from base wall 126. As a result, tension bar 136 is normally biased radially inwardly of roll 14. Thus, as the different sheets are removed from roll 14 so that the diameter thereof decreases, tension bar 136 always moves inwardly so as to engage the outer surface of roll 14. As shown best in FIG. 1, tension bar 136 holds the free end of the next sheet to be removed from roll 14. This prevents undesirable pulling of additional sheets from roll 14 and also prevents the next sheet that is to be pulled, from dangling freely.

With the above-described invention, base section 20 is first secured to a mounting surface 34 by screws 36. Then, second shaft portion 12*b* is inserted within annular boss 28, and base cover 42 is screwed onto base section 20 so as to releasably mount second shaft portion 12*b* to base means 16.

Then, outer tubular rod 84 is secured to the opposite end of second shaft portion 12*b* and oriented at the desired angle with respect thereto. The orientation of tubular rod 84 of third shaft portion 12*c* to second shaft portion will be described hereinafter with respect to FIGS. 1–4. Screw 94 is then tightened to releasably lock second shaft portion 12*b* and first telescoping rod 84 of third shaft portion 12*c* at the desired angular position with respect to each other. Inner tubular rod 86 is then moved within outer tubular rod 84 to the desired retracted or extended position, depending upon the relative angle between second shaft portion 12*b* and outer telescoping rod 84 of third shaft portion 12*c*. The roll 14 of paper towels is then inserted over shaft means 12 so as to be rotatably received thereon, and closure means 18 is then screw-threaded onto the end of inner telescoping rod 86 to prevent removal of roll 14 from shaft means 12, with tension bar 136 being pulled outwardly to contact the outer surface of roll 14. It will be appreciated that when the first and second shaft portions 12*a* and 12*b* are co-linear, the third shaft portion 12*c* must be in its retracted position and roll 14 is supported essentially by first and second shaft portions 12*a* and 12*b*. Alternatively, when the first and second shaft portions 12*a* and 12*b* are perpendicular to each other, the third shaft portion 12*c* must be in its extended position and roll 14 is supported by first and third shaft portions 12*a* and 12*c*.

Figure 1:
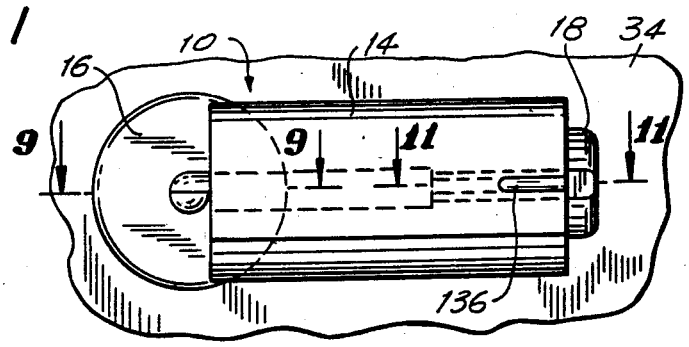
FIG. 1 is an elevational view of the paper towel holder according to the present invention mounted onto a wall for holding the roll of paper toweling in a horizontal orientation.
Figure 2:
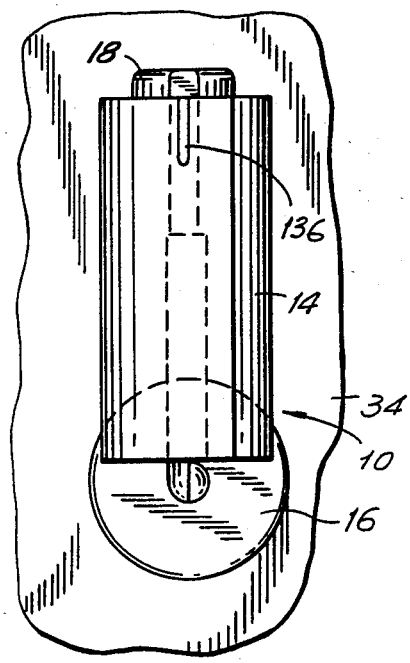
FIG. 2 is an elevational view of the paper towel holder according to the present invention mounted onto a wall for holding the roll of paper toweling in a vertical orientation.
Figure 3:
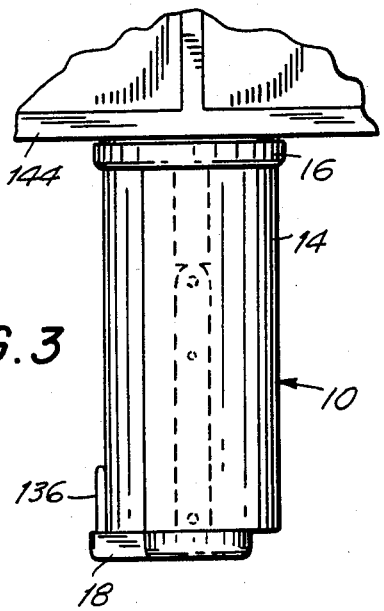
FIG. 3 is an elevational view of the paper towel holder according to the present invention mounted onto the underside of a cabinet and holding the roll of paper toweling in a vertical orientation.
Figure 4:
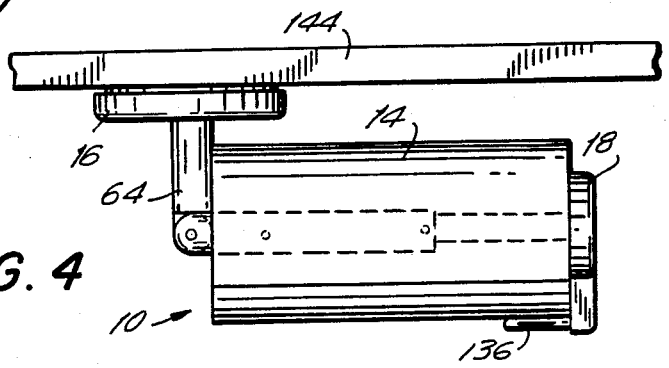
FIG. 4 is an elevational view of the paper towel holder according to the present invention mounted onto the underside of a cabinet and holding the roll of paper toweling in a horizontal orientation.

As shown in FIGS. 1–4, paper towel holder 10 can achieve numerous positions. For example, as shown in FIG. 1, base means 16 is secured to a vertical wall with roll 14 extending horizontally. In this case, outer tubular rod 84 of third shaft portion 12*c* is positioned at right angles to second shaft portion 12*b*, as shown in FIG. 5. When so positioned, second shaft portion 12*b* does not receive roll 14, and telescoping rod 86 is extended so that lock button 106 is positioned within second hole 98. FIG. 2 shows paper towel holder 10 arranged in the same manner as in FIG. 1, with the exception that base means 16 is rotated 90 degrees with respect to the arrangement shown in FIG. 1, such that roll 14 is oriented vertically upward. FIG. 4 shows the same arrangement as FIG. 1, with the exception that base means 16 is mounted to the underside of a cabinet 144, whereby roll 14 is oriented horizontally.

As shown in FIG. 3, base means 16 is also secured to the underside of a cabinet 144. However, in FIG. 3, first shaft portion 12*a* is colinear with second shaft portion 12*b*, and inner telescoping rod 86 is retracted within outer telescoping rod 84, with lock button 106 being positioned within first hole 96, whereby roll 14 is supported essentially by first and second shaft portions 12*a* and 12*b*.

Thus, with the present invention, numerous advantages are provided over conventional paper towel holders. Specifically, paper towel holder 10 can be mounted to any small area, because of the reduced area of base means 16 as compared with conventional elongated base members of prior art paper towel holders. In addition, paper towel holder 10 offers the flexibility of orienting roll 14 in a horizontal or vertical position. Still further, the next sheet of roll 14 to be removed is restrained by tension bar 136 so that it does not dangle loosely from roll 14.

While the present invention has been described with first, second and third shaft portions 12*a*, 12*b* and 12*c*, respectively, it will be appreciated that other arrangements can be provided within the scope of the present claimed invention. For example, first and third shaft portions 12*a* and 12*c* can be combined into an extendable length shaft portion, whereas second shaft portion 12*b* would remain a fixed length shaft portion.

Having described a specific preferred embodiment of the invention with reference to the accompanying drawings, it will be appreciated that the present invention is not limited to that precise embodiment, and that various changes and modifications can be effected therein by one of ordinary skill in the art without departing from the spirit or scope of the invention as defined in the appended claims.

What is claimed is:

1. A device for holding and dispensing paper toweling in roll form, comprising:

base means adapted to be mounted onto a supporting surface for supporting said device;

shaft means for rotatably supporting said roll, said shaft means including;

(a) a first shaft portion having first and second opposite ends;

(b) a second shaft portion having a first end secured to said base means and a second end secured to a first end of said first shaft portion, and means to secure said first and second shaft portions selectively in either a co-axial relation or a perpendicular relation; and (c) a third shaft portion having a free end and being telescopically receivable in said first shaft portion in a retracted position when said first and second shaft positions are secured in said co-axial relation and in an extended position when said first and second shaft portions are secured in perpendicular relation, whereby the effective shaft length corresponds at all times to the length of the paper toweling roll; and closure means secured to the free end of said third shaft portion for releasably restraining said roll on said shaft means.

2. Apparatus according to claim 1; wherein said base means includes a base securable to a supporting surface and a base cover removably secured on said base.

3. Apparatus according to claim 2; wherein said base includes a non-circular recess, and said first end of said second shaft portion includes a non-circular projecting surface having a configuration and dimensions similar to said non-circular recess for engagement therein so as to prevent rotation of said second shaft portion with respect to said base means.

4. Apparatus according to claim 3; wherein said second shaft portion includes a flange adjacent said first end thereof, and said second base cover includes flange means for engaging with the flange of said second shaft portion to retain said second shaft portion removably fixed to said base means.

5. Apparatus according to claim 1; wherein said second end of said second shaft portion includes a substantially flat surface and said first end of said first shaft portion includes a substantially flat surface, one of said flat surfaces having a plurality of recesses therein and the other of said flat surfaces having a plurality of projections therein for engaging within said recesses, and said securing means secures said first and second shaft portions together such that said projections are engaged within selected ones of said recesses to releasably fix said first and second shaft portions in either said co-axial relation or said perpendicular relation.

6. Apparatus according to claim 1; wherein said first shaft portion includes an outer telescoping rod and said third shaft portion includes an inner telescoping rod telescopically received within said outer telescoping rod.

7. Apparatus according to claim 6; wherein said outer telescoping rod includes at least two holes, and said inner telescoping rod includes lock button means engageable within one of said at least two holes for placing said third shaft portion in its retracted position and engageable within the other of said at least two holes for placing said third shaft portion in its extended position, and biasing means for normally biasing said lock button means outwardly into said at least two holes.

8. Apparatus according to claim 6; wherein said inner telescoping rod has a free screw-threaded end for screw-threadedly receiving said closure means.

9. Apparatus according to claim 1; wherein said closure means includes sheet material hold-down means for engaging an outer surface of said roll of sheet material, said hold-down means including a tension bar and biasing means for biasing said tension bar radially inward to engage the outer surface of said roll of sheet material.

10. Apparatus according to claim 9; wherein said closure means includes a radial trackway and said tension bar is slidably received within the trackway and biased radially inwardly of said trackway by said biasing means.

11. Apparatus for operatively holding a roll of sheet material having a central longitudinal aperture, said apparatus coomprising:

shaft means for rotatably supporting said roll, said shaft means including:

an extendable length shaft portion positionable through said longitudinal aperture and having a first end and a second, opposite end; and a fixed length shaft portion having a first end and a second, opposite end, the first end of said fixed length shaft portion being secured at a selected angular position to the second end of said extendable length shaft portion, said fixed length shaft portion being positionable through said longitudinal aperture when said extendable length and fixed length shaft portions are colinear;

base means secured to the second end of said fixed length shaft portion for supporting said shaft means; and closure means secured to the first end of said extendable length shaft portion for releasably restraining said roll on said shaft means;

said base means including a base securable to a supporting surface and a base cover removably secured on said base;

said base including a non-circular recess, and said second end of said fixed length shaft portion including a non-circular projecting surface having a configuration and dimensions similar to said non-circular recess for engagement therein so as to prevent rotation of said fixed length shaft portion with respect to said base means.

12. Apparatus according to claim 11; wherein said fixed length shaft portion includes a flange adjacent said second end thereof, and said second base cover includes flange means for engaging with the flange of said fixed length shaft portion to retain said fixed length shaft portion removably fixed to said base means.

13. Apparatus according to claim 11; wherein said shaft means further includes securing means for securing said extendable length and fixed length shaft portions at one of a plurality of pre-selected angular positions with respect to each other.

14. Apparatus according to claim 13; wherein said first end of said fixed length shaft portion includes a substantially flat surface and said second end of said extendable length shaft portion includes a substantially flat surface, one of said flat surfaces having a plurality of recesses therein and the other of said flat surfaces having a plurality of projections therein for engaging within said recesses, and said securing means secures said fixed length and extendable length shaft portions together such that said projections are engaged within selected ones of said recesses to releasably fix said fixed length and extendable length shaft portions at one of said pre-selected angular positions with respect to each other.

15. Apparatus according to claim 11; wherein said extendable length shaft portion includes an outer telescoping rod secured to said fixed length shaft portion and an inner telescoping rod telescopically received within said outer telescoping rod.

16. Apparatus according to claim 15; wherein said outer telescoping rod includes at least two holes, and said inner telescoping rod includes lock button means for engagement within one of said at least two holes and biasing means for normally biasing said lock button means outwardly into said at least two holes.

17. Apparatus according to claim 15; wherein said inner telescoping rod has a free screw-threaded end for screw-threadedly receiving said closure means.

18. Apparatus according to claim 11; wherein said closure means includes sheet material hold-down means for engaging an outer surface of said roll of sheet material, said hold-down means including a tension bar and biasing means for biasing said tension bar radially inward to engage the outer surface of said roll of sheet material.

19. Apparatus according to claim 18; wherein said closure means includes a radial trackway and said tension bar is slidably received within the track way and biased radially inwardly of said trackway by said biasing means.

20. A device for holding and dispensing paper toweling in roll form, comprising:

base means adapted to be mounted onto a supporting surface for supporting said device;

shaft means for rotatably supporting said roll, said shaft means including:

(a) a first shaft portion having first and second opposite ends;

(b) a second shaft portion having a first end secured to said base means and a second end secured to a first end of said first shaft portion, and means to secure said first and second shaft portions selectively in either a co-axial relation or a perpendicular relation; and (c) a third shaft portion having a free end and being telescopically receivable in said first shaft portion in a retracted position when said first and second shaft portions are secured in said co-axial relation for supporting said paper toweling roll on said first and second shaft portions, and said third shaft portion being receivable in said first shaft portion in an extended position when said first and second shaft portions are secured in perpendicular relation for supporting said paper toweling roll on said first and third shaft portion; and closure means secured to the free end of said third shaft portion for releasably restraining said roll on said shaft means.

* * * * *